US005887668A

United States Patent [19]

Haugen et al.

[11] Patent Number: 5,887,668

[45] Date of Patent: Mar. 30, 1999

[54] WELLBORE MILLING— DRILLING

[75] Inventors: David M. Haugen, League City; Frederick T. Tilton, Spring; Joseph D. Mills, Houston; Randy P. Hutchings, Pearland; Guy L. McClung, III, Spring; Steve R. Delgado, Houston, all of Tex.

[73] Assignee: Weatherford/Lamb, Inc., Houston, Tex.

[21] Appl. No.: 832,483

[22] Filed: Apr. 2, 1997

Related U.S. Application Data

[63] Continuation-in-part of Ser. No. 790,543, Jan. 30, 1997, Ser. No. 642,118, May 2, 1996, Pat. No. 5,806,595, and Ser. No. 752,359, Nov. 19, 1996, Pat. No. 5,787,978, which is a continuation-in-part of Ser. No. 655,087, Jun. 3, 1996, Pat. No. 5,620,051, which is a division of Ser. No. 414,338, Mar. 31, 1995, Pat. No. 5,522,461, and a continuation-in-part of Ser. No. 542,439, Oct. 12, 1995, Pat. No. 5,720,349, said Ser. No. 790,543, is a continuation-in-part of Ser. No. 673,791, Jun. 27, 1996, abandoned, which is a continuation-in-part of Ser. No. 210,697, Mar. 18, 1994, Pat. No. 5,429,187, and a division of Ser. No. 414,201, Mar. 31, 1995, Pat. No. 5,531,271, which is a continuation-in-part of Ser. No. 300,917, Sep. 6, 1994, Pat. No. 5,425,417, which is a continuation-in-part of Ser. No. 225,384, Apr. 4, 1994, Pat. No. 5,409,060, which is a continuation-in-part of Ser. No. 119,813, Sep. 10, 1993, Pat. No. 5,452,759.

[51] Int. Cl.[6] ..... E21B 7/08

[52] U.S. Cl. ..... 175/79; 175/81

[58] Field of Search ..... 166/61, 62, 79–83

[56] References Cited

U.S. PATENT DOCUMENTS

| | | |
|---|---|---|
| 1,387,447 | 8/1921 | Alford . |
| 1,454,048 | 5/1923 | Esperson . |
| 1,502,427 | 7/1924 | Getty . |
| 1,522,593 | 1/1925 | Pickin . |
| 1,532,330 | 4/1925 | Mitchell . |
| 1,571,931 | 2/1926 | Church . |
| 1,610,569 | 12/1926 | Maynard . |
| 1,636,032 | 7/1927 | Abbott . |
| 1,698,496 | 1/1929 | Gray . |
| 1,727,563 | 9/1929 | Ross . |
| 1,899,727 | 2/1933 | Sandstone . |
| 2,124,414 | 7/1938 | Goldman . |

(List continued on next page.)

FOREIGN PATENT DOCUMENTS

| | | |
|---|---|---|
| 80 303725 | of 1980 | European Pat. Off. . |
| 2 307 704 | 6/1997 | United Kingdom . |

OTHER PUBLICATIONS

Shell Expro's first application of coiled tubing drilling, World Oil,Jun. 97.

WHIPCO Blast Stock, Whipstock, Inc., Composite Catalog 1970–71, pp. 4984–4986.

Red Baron Oil Tools Rental, 1989.

US Official Gazette entries, Aug. 12, 1997, for U.S. Patents 5,655,613; and Sep. 16, 1997, for 5,667,023.

(List continued on next page.)

*Primary Examiner*—Roger Schoeppel

*Attorney, Agent, or Firm*—Guy McClung

[57] ABSTRACT

A tool for wellbore sidetracking operations has been invented, the tool, in one aspect, having a body, a milling section on the body for milling an opening in a tubular in a first wellbore in a formation, the milling section having milling material thereon, and a drilling section on the body for drilling a second wellbore beyond the window into the formation. A method has been invented for forming an opening in a tubular in a first wellbore in a formation and for drilling a second wellbore from the opening in a single trip procedure, the method positioning a mill drill tool in the tubular at a location at which an opening is desired in the tubular and from which a second wellbore is desired to be drilled, the mill drill tool having drilling apparatus for drilling the second wellbore and milling apparatus for milling an opening through the tubular, milling the opening in the tubular with the milling apparatus thereby exposing the formation for drilling, and drilling with the drilling apparatus a second wellbore beyond the opening in the tubular into the formation.

13 Claims, 12 Drawing Sheets

U.S. PATENT DOCUMENTS

| | | | |
|---|---|---|---|
| 2,203,747 | 6/1940 | Sandstone | 175/379 |
| 2,223,864 | 12/1940 | Zublin . | |
| 2,234,273 | 3/1941 | Pennington | 175/379 |
| 2,267,833 | 12/1941 | McMahan . | |
| 2,296,939 | 9/1942 | McMahan | 255/1 |
| 2,342,292 | 2/1944 | Morissette . | |
| 2,452,920 | 11/1948 | Gilbert | 166/50 |
| 2,485,826 | 10/1949 | Harinck . | |
| 2,543,861 | 3/1951 | Mader . | |
| 2,554,780 | 5/1951 | Goolsbee . | |
| 2,633,682 | 4/1953 | Jackson . | |
| 2,644,672 | 7/1953 | Mathews | 175/307 |
| 2,645,456 | 7/1953 | Thompson . | |
| 2,723,836 | 11/1955 | Fraser | 175/307 X |
| 2,754,090 | 7/1956 | Kammerer . | |
| 2,833,520 | 5/1958 | Owen . | |
| 2,855,994 | 10/1958 | Kammerer, Jr. . | |
| 2,877,988 | 3/1959 | Cameron et al. . | |
| 2,882,015 | 4/1959 | Beck . | |
| 3,066,749 | 12/1962 | Hildebrandt | 175/317 |
| 3,066,750 | 12/1962 | Hildebrandt | 175/329 |
| 3,147,536 | 9/1964 | Lamphere . | |
| 3,227,230 | 1/1966 | Lagerstrom | 175/214 |
| 3,295,617 | 1/1967 | Willis | 175/379 |
| 3,330,349 | 7/1967 | Owsley et al. | 166/117.5 |
| 3,343,615 | 9/1967 | Terry | 175/406 |
| 3,367,430 | 2/1968 | Rowley | 175/385 |
| 3,537,538 | 11/1970 | Generoux | 175/330 |
| 3,685,600 | 8/1972 | Lorenz et al. | 175/307 |
| 3,718,196 | 2/1973 | Lorenz et al. | 175/307 |
| 3,765,493 | 10/1973 | Rosar et al. | 175/319 |
| 3,788,407 | 1/1974 | Lorenz et al. | 175/307 |
| 3,908,759 | 9/1975 | Cagle et al. | 166/117.6 |
| 4,244,432 | 1/1981 | Rowley et al. | 175/329 |
| 4,253,533 | 3/1981 | Baker, III | 175/329 |
| 4,266,621 | 5/1981 | Brock | 175/329 |
| 4,290,498 | 9/1981 | Triplett et al. | 175/379 |
| 4,359,335 | 11/1982 | Garner | 75/208 R |
| 4,396,075 | 8/1983 | Wood et al. | 175/79 |
| 4,396,077 | 8/1983 | Radtke | 175/329 |
| 4,397,361 | 8/1983 | Langford, Jr. | 175/329 |
| 4,440,247 | 4/1984 | Sartor | 175/393 |
| 4,533,004 | 8/1985 | Ecer | 175/329 |
| 4,573,541 | 3/1986 | Josse et al. | 175/78 |
| 4,717,290 | 1/1988 | Reynolds et al. | 407/34 |
| 4,719,979 | 1/1988 | Jones | 175/329 |
| 4,766,040 | 8/1988 | Hillert et al. | 428/552 |
| 4,796,709 | 1/1989 | Lynde et al. | 166/55.6 |
| 4,797,138 | 1/1989 | Komanduri | 51/293 |
| 4,848,491 | 7/1989 | Burridge et al. | 175/329 |
| 4,887,668 | 12/1989 | Lynde et al. | 166/55.8 |
| 4,978,260 | 12/1990 | Lynde et al. | 166/55.6 |
| 5,004,057 | 4/1991 | Tibbitts et al. | 175/408 |
| 5,038,859 | 8/1991 | Lynde et al. | 166/55.6 |
| 5,038,873 | 8/1991 | Jurgens | 175/246 |
| 5,058,666 | 10/1991 | Lynde et al. | 166/55.6 |
| 5,069,584 | 12/1991 | Obermeier et al. | 408/145 |
| 5,086,838 | 2/1992 | Cassel et al. | 166/55.6 |
| 5,109,924 | 5/1992 | Jurgens et al. | 166/117.5 |
| 5,150,755 | 9/1992 | Cassel et al. | 166/297 |
| 5,193,620 | 3/1993 | Braddick | 166/382 |
| 5,199,513 | 4/1993 | Stewart et al. | 175/73 |
| 5,279,374 | 1/1994 | Sievers et al. | 175/374 |
| 5,289,876 | 3/1994 | Graham | 166/276 |
| 5,289,889 | 3/1994 | Gearhart et al. | 175/325.5 |
| 5,301,760 | 4/1994 | Graham | 175/61 |
| 5,318,122 | 6/1994 | Murray et al. | 166/313 |
| 5,322,127 | 6/1994 | McNair et al. | 166/313 |
| 5,337,808 | 8/1994 | Graham | 166/191 |
| 5,341,873 | 8/1994 | Carter et al. | 166/117.5 |
| 5,353,876 | 10/1994 | Curington et al. | 166/313 |
| 5,361,859 | 11/1994 | Tibbitts | 175/286 |
| 5,373,900 | 12/1994 | Lynde et al. | 166/297 |
| 5,388,648 | 2/1995 | Jordan, Jr. | 166/380 |
| 5,423,387 | 6/1995 | Lynde | 175/61 |
| 5,425,417 | 6/1995 | Carter | 166/117.6 |
| 5,425,419 | 6/1995 | Sieber | 166/206 |
| 5,427,177 | 6/1995 | Jordan, Jr. et al. | 166/50 |
| 5,431,220 | 7/1995 | Lennon et al. | 166/55.7 |
| 5,435,400 | 7/1995 | Smith | 175/61 |
| 5,445,222 | 8/1995 | Pritchard et al. | 116/298 |
| 5,456,312 | 10/1995 | Lynde et al. | 166/55.6 |
| 5,458,209 | 10/1995 | Hayes et al. | 175/61 |
| 5,462,120 | 10/1995 | Gondovin | 166/380 |
| 5,467,819 | 11/1995 | Bradick | 166/117.6 |
| 5,474,126 | 12/1995 | Lynde et al. | 166/117.6 |
| 5,474,131 | 12/1995 | Jordan, Jr. et al. | 166/313 |
| 5,477,925 | 12/1995 | Trahan et al. | 166/382 |
| 5,522,461 | 6/1996 | Carter et al. | 166/298 |
| 5,526,880 | 6/1996 | Jordan, Jr. et al. | 166/291 |
| 5,531,271 | 7/1996 | Carter | 166/117.6 |
| 5,533,573 | 7/1996 | Jordan, Jr. et al. | 166/313 |
| 5,544,704 | 8/1996 | Laurel et al. | 166/117.6 |
| 5,551,509 | 9/1996 | Braddick | 166/55.7 |
| 5,564,503 | 10/1996 | Longbottom et al. | 166/313 |
| 5,566,763 | 10/1996 | Williamson et al. | 166/382 |
| 5,584,350 | 12/1996 | Schnitker et al. | 175/61 |
| 5,592,991 | 1/1997 | Lembcke et al. | 166/298 |
| 5,620,051 | 4/1997 | Carter et al. | 166/298 |
| 5,641,027 | 6/1997 | Foster | 175/107 |
| 5,647,436 | 7/1997 | Braddick | 166/298 |
| 5,647,437 | 7/1997 | Braddick et al. | 166/382 |
| 5,651,415 | 7/1997 | Scales | 166/250.09 |
| 5,655,602 | 8/1997 | Collins | 166/313 |
| 5,655,612 | 8/1997 | Grimes et al. | 175/401 |
| 5,655,614 | 8/1997 | Azar | 175/404 |
| 5,657,820 | 8/1997 | Bailey et al. | 166/55.7 |
| 5,678,634 | 10/1997 | Rehbock et al. | 166/377 |
| 5,697,438 | 12/1997 | Rehbock et al. | 166/55.7 |
| 5,697,445 | 12/1997 | Graham | 166/313 |
| 5,715,891 | 2/1998 | Graham | 166/313 |
| 5,725,060 | 3/1998 | Blount et al. | 175/61 |
| 5,727,629 | 3/1998 | Blizzard, Jr. et al. | 166/298 |
| 5,730,221 | 3/1998 | Longbottom et al. | 166/298 |
| 5,730,224 | 3/1998 | Williamson et al. | 166/386 |
| 5,732,773 | 3/1998 | Parks et al. | 166/117.5 |
| 5,735,350 | 4/1998 | Longbottom et al. | 166/313 |

OTHER PUBLICATIONS

Slim–Hole and Coiled–Tubing Window Cutting Systems, SPE 26714, Faure et al, Sep. 1993 pp. 351–357.

Improved Casing Sidetrack Procedure Now Cuts Wider, Longer Windows, Cagle et al, Petroleum Engineer, Mar. 1979.

Horizontal Slim–Hole Drilling With Coiled Tubing: An Operator's Experience, Ramos et al, Society of Petroleum Engineers, 1992 pp. 152–158.

System Limits Sidetracking Trips To Single Operation, p. 33, Hart's Petroleum Engineer Int'l, Apr. 1997.

Multilateral Systems, Halliburton, 1996.

TIW Window Cutting Systems, TIW Corp., 1994.

1994–95 TIW General Catalog, 1993, pp. 2, 3–6.

Technologies Spur Horizontal Activity, Crouse, American Oil & Gas Reporter, Aug. 1997. pp. 62, 64, 67.

Multilaterals Achieve Success In Canada, The Netherlands, Hart's Petroleum Engineer Int'l. Jun. 1997, pp. 49, 51, 52.

Multilateral Wells Can Multiply Reserve Potential, Longbottom et al, American Oil & Gas Reporter, Sep. 97, pp. 53, 54, 56, 58.

Int'l Search Report PCT/GB98/00197.

Int'l Search Report PCT/GB98/00192.

500
520
522
523
527
511
527
522
521
524
526
513
A'
S
512
B
510
G
505
C'
D
d
G

WELLBORE MILLING— DRILLING

RELATED APPLICATIONS

This is a continuation-in-part of U.S. application Ser. No. 08/790,543 filed Jan. 30, 1997 entitled "Wellbore Milling & Drilling" which is a continuation-in-part of U.S. application Ser. No. 08/673,791 filed on Jun. 27, 1996 entitled "Wellbore Securement System," now abandoned which is a continuation-in-part of U.S. application Ser. No. 08/210,697 filed on Mar. 18, 1994 entitled "Milling Tool & Operations" now U.S. Pat. No. 5,429,187 issued Jul. 4, 1995 and is a division of application Ser. No. 414,201 filed on Mar. 31, 1995 entitled "Whipstock Side Support" now U.S. Pat. No. 5,531,271 issued Jul. 2, 1996, which is a continuation-in-part of U.S. application Ser. No. 08/300,917, filed on Sep. 6, 1994 entitled "Wellbore Tool Setting System" now U.S. Pat. No. 5,425,417 issued Jun. 20, 1995 which is a continuation-in-part of U.S. application Ser. No. 08/225,384, filed on Apr. 4, 1994 entitled "Wellbore Tool Orientation," now U.S. Pat. No. 5,409,060 issued on Apr. 25, 1995 which is a continuation-in-part of U.S. application Ser. No. 08/119,813 filed on Sep. 10, 1993 entitled "Whipstock System" now U.S. Pat. No. 5,452,759 issued on Sep. 26, 1995. This is a continuation-in-part of U.S. application Ser. No. 08/642,118 filed May 20, 1996 entitled "Wellbore Milling System" now U.S. Pat. No. 5,806,595 and of U.S. application Ser. No. 08/752,359 filed Nov. 19, 1996 entitled "Multi-Face Whipstock With Sacrificial Face Element" now U.S. Pat. No. 5,787,978 is a continuation-in-part of U.S. application Ser. No. 08/655,087 filed Jun. 3, 1996 entitled "Whipstock" now U.S. Pat. No. 5,620,051 which is a division of U.S. application Ser. No. 08/414,338 filed Mar. 31, 1995 entitled "Mill Valve" issued as U.S. Pat. No. 5,522,461 on Jun. 4, 1996, and a continuation-in-part of U.S. application Ser. No. 08/542,439 filed Oct. 12, 1995 entitled "Starting Mill and Operations" now U.S. Pat. No. 5,720,349. All applications cited above are co-owned with the present invention and incorporated herein in their entirety for all purposes.

BACKGROUND OF THE INVENTION

1. Field of the Invention

This invention is related to: milling and drilling methods, tools and whipstocks; wellbore sidetracking systems and procedures; and, in one aspect, to single-trip mill-drill methods and systems.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools. Drilling systems are used to drill wellbores, both main boreholes and lateral bores extending therefrom. The prior art discloses various types of drilling, milling and cutting tools provided for drilling a formation or for cutting or milling existing pipe or casing previously installed in a well. Certain of these tools have cutting blades or surfaces and are lowered into the well or casing and then rotated in a drilling or milling operation. With certain tools, a suitable drilling fluid is pumped down a central bore of a tool for discharge beneath the cutting blades. An upward flow of the discharged fluid in the annulus outside the tool removes from the well cuttings or chips resulting from the cutting operation. Milling of casing can result in the formation of part of a lateral borehole when a mill exits the casing and bores into the formation.

Milling tools have been used for removing a section or "window" of existing casing from a well bore to permit a sidetracking operation in directional drilling. Also, milling tools are used for milling or reaming collapsed casing, for removing burrs or other imperfections from windows in the casing system, for placing whipstocks in directional drilling, or for aiding in correcting dented or mashed-in areas of casing or the like.

Prior art sidetracking methods use cutting tools of the type having cutting blades and use a diverter or a deflector such as a whipstock to cause the tool to be moved laterally while it is being moved downwardly in the well during rotation of the tool to cut an elongated opening, pocket, or window in the well casing.

Certain prior art well sidetracking operations which employ a whipstock also employ a variety of different milling tools used in a certain sequence. This sequence of operation requires a plurality of "trips" into the wellbore. For example, in certain multi-trip operations, a packer is set in a wellbore at a desired location. This packer acts as an anchor against which tools above it may be urged to activate different tool functions. The packer typically has a key or other orientation indicating member. The packer's orientation is checked by running a tool such as a gyroscope indicator into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the stinger and engage the side of the wellbore to prevent movement of the tool in the wellbore. Pulling or pushing on the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill off the pilot lug and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore and a separate drilling tool is then introduced into the wellbore to drill a secondary bore in the formation.

There has long been a need, recognized by the present inventors, for an efficient and effective milling-drilling method. There has long been a need for tools useful in such methods, particularly in single-trip milling-drilling methods.

SUMMARY OF THE PRESENT INVENTION

The present invention, in certain embodiments, discloses a system for making an opening in a tubular in a first wellbore in a formation and drilling a borehole through the formation all in one trip into the wellbore. In certain aspects, a mill-drill system is used to form such a borehole which system both mills through a tubular lining the wellbore and also drills the borehole past the milled opening in the tubular. In certain embodiments, the present invention discloses a system having milling apparatus for milling the tubular, and drilling apparatus at least a portion of which or substantially all is covered with a material to be weakened, broken, or worn away by contacting the tubular and/or by contacting the earth formation outside the first wellbore, thereby exposing or freeing the drilling apparatus for drilling a secondary wellbore.

In one aspect the material on the drilling apparatus is a ring around the drilling apparatus and in another aspect it is a partial ring. In one aspect the milling apparatus is outside of and wearable away from the drilling apparatus. In one aspect the drilling apparatus includes formation cutting structure, drill inserts or element(s), and/or a bit or roller cone(s) covered by milling material, a milling structure, or wear-away material that includes milling material. The milling material is worn away as the milling apparatus mills a tubular and/or by contacting the earth formation. In one aspect a wear away lower nose on the tool body is made of a bearing material and the nose acts as a bearing as the mill moves down a whipstock. In one aspect cutting apparatus is covered by a matrix, e.g. brass, which includes milling material, e.g. crushed carbide and/or carbide milling inserts or elements, the covering such that against a relatively hard formation or an abrasive formation the covering is abraded to expose the drilling apparatus.

In one aspect the present invention discloses a system for making an opening in a tubular in a wellbore in a formation, the system having a body, cutting apparatus on the body for cutting the tubular, and material on at least a portion of the cutting apparatus, the material to be worn away by contacting the tubular and/or earth formation thereby exposing the cutting apparatus for drilling a lateral or secondary wellbore; such a system wherein the cutting apparatus is suitable for cutting a completed window through the tubular in a single trip of the system into the wellbore; any such system wherein the cutting apparatus is also suitable for drilling a wellbore beyond the main wellbore and window into the formation.

In one aspect the present invention discloses a mill-drill tool in which drilling apparatus is initially within milling apparatus and the drilling apparatus is selectively advanceable out from the milling apparatus (or what remains of it) to expose and/or free the drilling apparatus to drill an earth formation.

In one aspect the present invention discloses a method for forming a borehole in communication with a wellbore lined with tubulars (such as, but not limited to, casing), the method including positioning a mill-drill apparatus in the tubular at a location at which an opening is desired in the tubular, the apparatus having a body and milling apparatus and drilling apparatus, milling the opening in the tubular with the milling apparatus and then drilling the borehole away from the opening with the drilling apparatus. In various aspects the milling apparatus is worn away as it mills to expose the drilling apparatus; the milling apparatus is releasably connected to the drilling apparatus by a release member (including but not limited to a shearable release member; a chemically-activated and/or chemically eroded release member; an electrically actuated release member; a mechanically activated release member; or an ultrasonically activated release member); or drilling apparatus is movable from an inoperative position on the apparatus while milling is done to an operative drilling position for drilling after milling is completed. In various aspects the drilled borehole is any desired length, including but not limited to one hundred feet, three hundred feet, five hundred feet, one thousand feet, two thousand feet, or three thousand feet in length or more and at any desired angle to the main wellbore.

The present invention discloses, in certain aspects, mill-drill tools that include both milling structure (e.g. like known blades, surfaces, or combinations thereof on a tool body with or without matrix milling material and/or with or without milling inserts in any known arrangement, array, or pattern) and drilling structure (e.g. like any known drill bit and/or drill bit rotary roller cones). One drill bit rotary roller cone according to the present invention has a milling surface or blade and/or a body of milling material thereon. In one aspect one or more rotatable drilling roller cones has its drilling surface substantially coincident with the face milling portion of a milling surface of a mill-drill tool. In one aspect the roller cone(s) are selectively prevented from rotating until milling of a tubular is completed and drilling of a formation is to be commenced. In another aspect a "skin" of milling material over one or more roller cones immobilizes the roller cones. Once the milling "skin" has been worn away by milling and/or contact with the formation through which the wellbore extends, the roller cones are freed for drilling the formation. In another aspect such a "skin" covers a face of drilling material.

In another aspect the present invention discloses a mill-drill tool with blades or surfaces which can be used for milling and for drilling. For milling, a movable wear pad cover member adjacent each such blade or surface is moved to expose a suitable amount of the blade or surface to effect efficient milling, i.e., an operation in which metal is continuously milled. Typically, drilling requires that a "bigger bite" be taken by a cutter. For drilling, the wear pad or cover member is moved to expose more of each blade or surface so that the tool can adequately function as a formation drill.

In certain embodiments the present invention discloses: a system for making an opening in a tubular in a wellbore in a formation, the system having a body, cutting apparatus on the body for cutting the tubular, material covering at least a portion of the cutting apparatus, the material to be worn away by contacting the tubular and/or by earth formation thereby exposing the cutting apparatus; such a system wherein the cutting apparatus is suitable for cutting a completed window through the tubular in a single trip of the system into the wellbore; and such a system wherein the cutting apparatus is suitable for cutting a second wellbore beyond a window into the formation.

The present invention, in one embodiment, discloses an insert for milling-drilling that has a first portion suitable for milling the material of which a wellbore tubular is made and a second portion for drilling a formation through which the wellbore extends. In one aspect a mill-drill tool according to the present invention has a plurality of such inserts affixed thereto. In another aspect a plurality of milling inserts are emplaced in or affixed to a mill-drill tool in front of a plurality of drilling elements or inserts. A plurality of such inserts may be used on the face and/or sides of a mill-drill tool.

In another embodiment, a mill-drill tool is provided which has cutting inserts or elements which can cut both metal (e.g. the steel of which tubulars are made) and earth formation; e.g. but not limited to elements made of polycrystalline cubic boron nitride ("PCBN").

The present invention, in certain embodiments, discloses a tool for wellbore sidetracking operations and methods of its use, the tool including a body, a milling section on the body for milling an opening in a tubular in a first wellbore in a formation, the milling section having a body with milling material thereon, and a drilling section on the body for drilling a second wellbore beyond the window into the formation; such a tool wherein the milling section is a full gauge milling apparatus so that the second wellbore is of a substantially uniform diameter along its entire length; such a tool with a release member interconnected between the drilling section and the milling section for selectively releasing the milling section from the drilling section thereby freeing the drilling section for drilling; such a tool wherein the milling section includes a plurality of milling blades extending from the body; such a tool wherein the milling section comprises a window mill; such a tool wherein the milling section comprises a plurality of blades with a plurality of cutting elements therein; and such a tool wherein the plurality of cutting elements comprises a plurality of milling elements and a plurality of drilling elements; such a tool with a plurality of mill drill elements on the body; such a tool wherein the drilling section includes a plurality of bit roller cones rotatably secured to the body; such a tool wherein each bit roller cone is secured to an arm secured to the body; any such tool wherein an exterior surface of each arm has milling material thereon; any such tool wherein each bit roller cone has a plurality of mill drill elements thereon; such a tool wherein the drilling section is a drill collar having a body with projections extending laterally therefrom and drilling material on an exterior surface of each projection.

The present invention, in certain embodiments, discloses a system for wellbore sidetracking operations for making an opening in a tubular in a first wellbore in a formation and for drilling a borehole away from the opening in the formation in a single trip procedure, the system comprising a single tool with milling means and drilling means, the milling means for milling the tubular, the milling means suitable for cutting a completed window through the tubular in a single trip of the system into the wellbore, the drilling means suitable for drilling a second wellbore beyond the window into the formation, and a whipstock to which the tool is releasably secured for directing the tool away therefrom toward the tubular.

The present invention, in certain embodiments, discloses a method for forming an opening in a tubular in a first wellbore in a formation and for drilling a second wellbore from the opening in a single trip procedure, the method including positioning a mill drill tool in the tubular at a location at which an opening is desired in the tubular and from which a second wellbore is desired to be drilled, the mill drill tool having drilling apparatus for drilling the second wellbore and milling apparatus for milling an opening through the tubular, milling the opening in the tubular with the milling apparatus thereby exposing the formation for drilling, and drilling with the drilling apparatus a second wellbore beyond the opening in the tubular into the formation; such a method wherein the mill drill tool has a release member interconnected between the drilling apparatus and the drilling apparatus for selectively releasing them to free the drilling apparatus for drilling, the method including releasing the milling apparatus from the drilling apparatus prior to drilling the second wellbore; such a method wherein the drilling apparatus, according to the present invention, is initially held within the milling apparatus and the mill-drill tool having advance apparatus for moving the drilling apparatus beyond the milling apparatus for drilling, and the method including advancing the drilling apparatus from the milling apparatus for drilling the second wellbore.

The present invention, in certain embodiments, discloses a mill-drill element for use on a wellbore sidetracking apparatus, the mill-drill element including a body having a first portion and a second portion, the first portion made of milling material suitable for milling an opening in a wellbore tubular, and the second portion made of drilling material suitable for drilling an earth formation beyond the wellbore tubular; and a mill-drill tool with a plurality of such elements on an operative surface thereof or with such surface [end face and/or lateral surface(s)] substantially covered with such elements.

It is, therefore, an object of at least certain preferred embodiments of the present invention to provide:

New, useful, unique, efficient, non-obvious milling-drilling systems and methods for milling-drilling operations;

A milling system and method requiring a single trip into a wellbore to create a desired opening or window in a tubular in the wellbore and a desired borehole extending away from the wellbore;

A milling method in which a window is milled at a desired location in a casing;

A mill-drill insert having both milling and drilling portions, and a tool with a plurality of such inserts;

A mill-drill tool with milling apparatus and drilling apparatus in a single tool; and New, useful, unique, efficient non-obvious systems for producing at least part of a lateral wellbore extending from a main wellbore; and such systems which efficiently both mill tubulars and drill in a formation.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 1 is a side view of a mill drill tool according to the present invention.

FIG. 2 is a side view of a mill drill tool according to the present invention.

DESCRIPTION OF EMBODIMENTS PREFERRED AT THE TIME OF FILING FOR THIS PATENT

Figure 3:
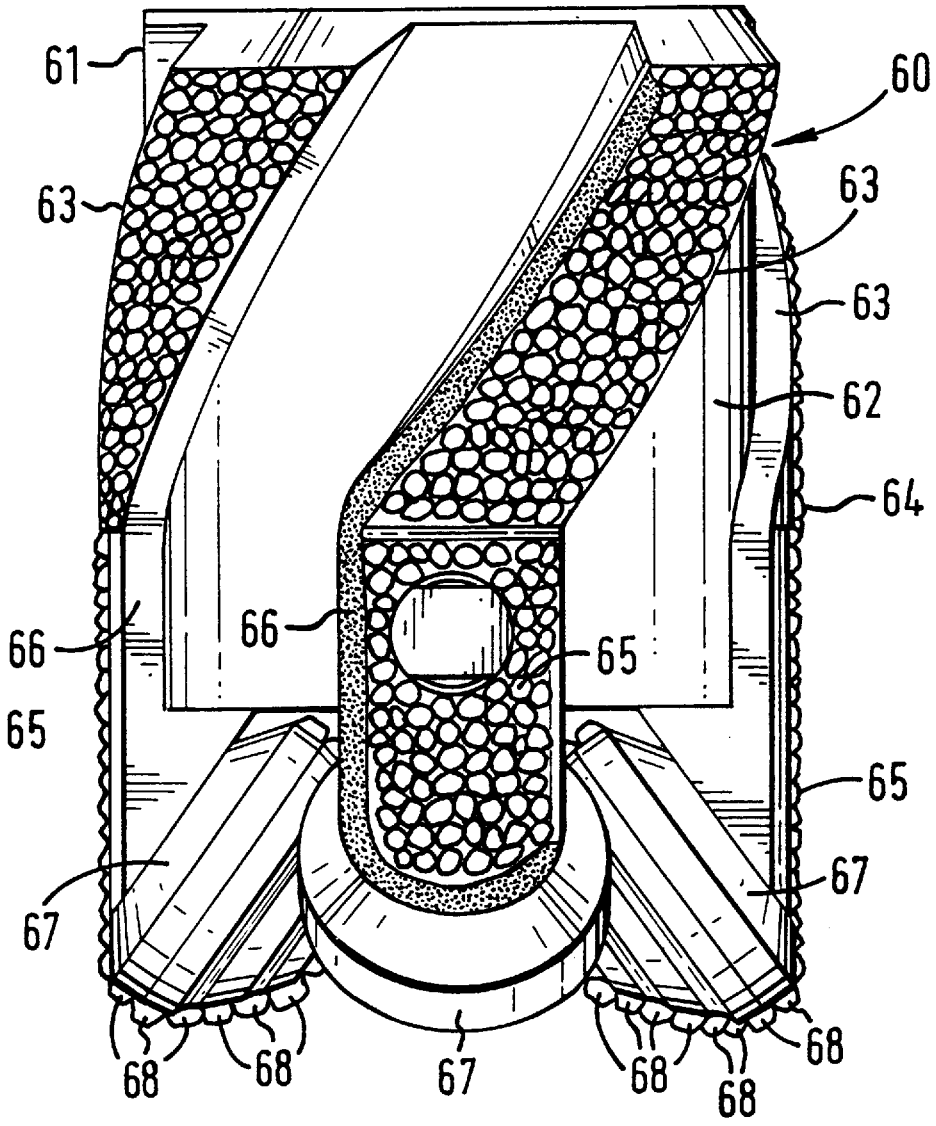
FIG. 3 is a side view of a mill drill tool according to the present invention.

Referring now to FIG. 1 a mill drill tool 10 is shown schematically which has a tubular body 12 with an upper threaded portion 14 for connection to a tubular string (not shown) for use in a wellbore extending from the earth's surface down through an earth formation. The tubular string may be rotated by a conventional rotary table or by a downhole motor in the string. It may be a string of drill pipe or similar tubulars or a coiled tubing string.

The mill drill tool 10 has a lower milling section 20 with milling material 22 thereon for milling a tubular, e.g. a liner, casing or tubing, which lines a wellbore and/or extends down through a wellbore or through a wellbore and a lateral wellbore communicating therewith. The milling section 20 may be configured as any known mill, e.g. but not limited to a typical window mill with milling material on a front lower face 24 thereof and on sides 26 thereof. "Milling material" means any known milling material, crushed carbide, matrix milling material, and/or milling elements or inserts of any suitable size, shape and configuration applied in any suitable known array, arrangement, or pattern. The milling material is suitable for milling an opening through a downhole tubular so that then a drill section 30 may drill a borehole from the opening away from the tubular into formation through which the wellbore extends. Preferably the mill section 20 is worn down as it mills the opening and/or as it enters the formation so that the drill section 30 is exposed or freed to drill the borehole. The drill section 30 may be any suitable known drill or drill bit employing drilling material 32 which may be any suitable known drilling material and/or drilling insert(s) or element(s). Known appropriate fluid passageways may be provided through the body 12 to the drill section 30 and mill section 20 (and also for any tool described herein).

FIG. 2 shows schematically a mill drill tool 40 according to the present invention with a tubular body 42, a drill section 44 (like the drill section 30, FIG. 1), a mill section 46 (like the mill section 20 20, FIG. 1), and a release section 50 connected between the drill section 44 and mill section 46.

The release section 50 is either releasably connected to the drill section 44 or the mill section 46 is releasably connected to the drill release section 50 so that upon the completion of an opening through a tubular member the drill section 44 and mill section 46 may be separated so that the drill section 44 is freed to drill a borehole in a formation through which the tubular member extends in a string of wellbore tubulars.

In the aspect in which the mill section 46 is released from the release section 50, the release section is, preferably made of an easily drillable material. In one aspect the release section is shear pinned to the drill section 44 and the shear pins are sheared by pushing or pulling on the tool or by using a mechanical selectively operable shearing mechanism. In one aspect the release section 50 is made of a chemically responsive material, e.g. a metal (e.g. aluminum (which is erodable e.g. by ammonia), plastic, or composite which is weakened and/or eroded by the introduction of a particular chemical specific to the material used to which the release section is chemically responsive, thereby releasing the release section from the drill section or releasing the mill section from the release section. Alternatively, chemically responsive connectors, e.g. pins, screws, bolts, are used to connect the sections together. In another aspect only enough of a chemical (e.g. an acid) is introduced in the area of and/or applied to the tool to erode, corrode, or weaken a mill section so that, upon contacting a formation, the mill section separates from the drill section. In one aspect timed deteriorating connectors are used, e.g. bolts with erosive chemicals therein that erode in a time sufficient to allow the introduction of the tool 50 into the wellbore and the milling of the desired tubular window.

In one aspect the release section 50 is made of suitable material (e.g. but not limited to ceramics, cermets, glass, or metal members of appropriate dimensions) which is responsive to heat or sonic waves generated and directed at the release section by a heat (or sonic) generator to weaken or sever the release section 50 to effect its separation from the drill section 44.

FIG. 3 shows a mill drill tool 60 which, in some respects, is similar to the bit disclosed in U.S. Pat. No. 5,289,889 (incorporated fully herein for all purposes), but which, according to the present invention, is useful not only for drilling a borehole but also for milling a tubular window prior to drilling.

The mill drill tool 60 has an internally threaded top end 61 of a body 62. A plurality of milling blades 63 project from and surround the body 62 and are covered with milling material 64. Milling material 65 is also on journal segment arms 66 which are affixed to a lower end of the body 62. Each of a plurality of roller cone cutters 67 with a cutting structure of inserts 68 is rotatably mounted on one of the arms 66. The inserts 68 may be any of the mill drill inserts or elements described herein or they may be known drilling inserts. In one aspect the roller cones are selectively held immobile until milling is completed.

FIGS. 4A–4D show a mill drill tool 70 according to the present invention which, in some aspects, is similar to the bits disclosed in U.S. Pat. No. 4,244,432 (incorporated fully herein for all purposes), but which is useful not only for drilling a borehole but for milling a tubular window in a wellbore tubular prior to drilling the borehole. This mill drill tool and the others disclosed herein may be used to produce a borehole from a main wellbore in a single trip into the main wellbore in which both tubular milling and borehole drilling are accomplished.

Figure 4A:
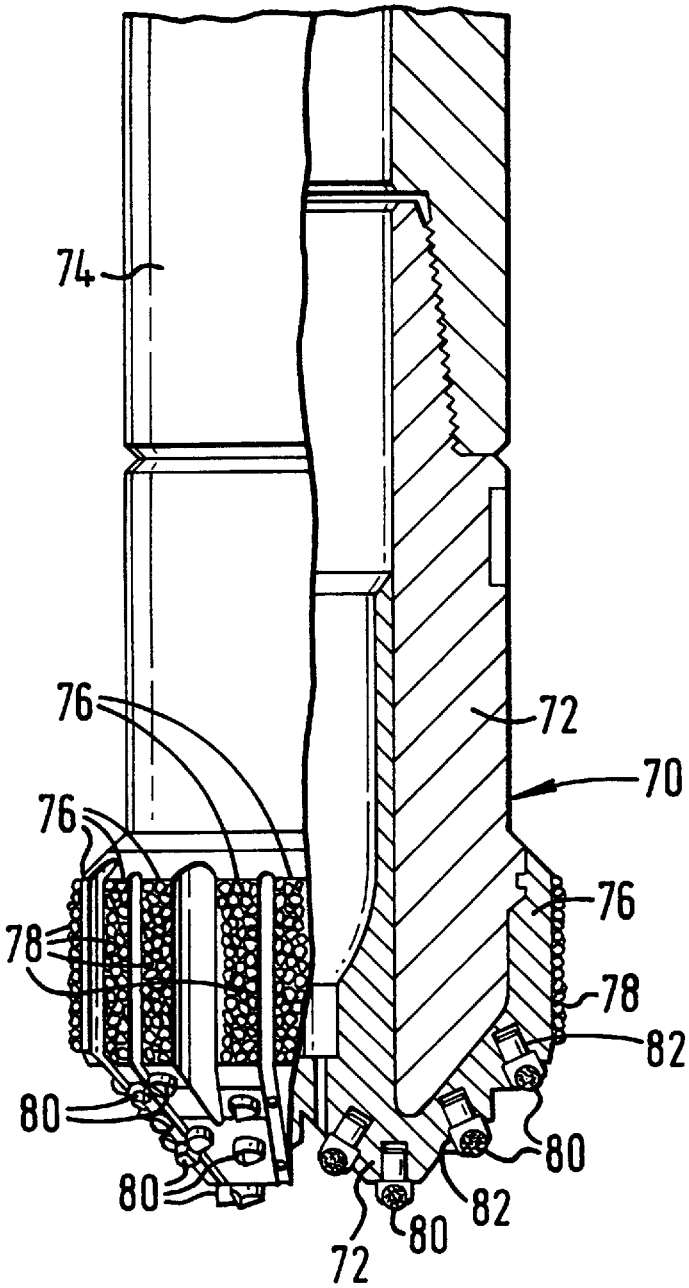
FIG. 4A is a side view, partially in cross-section of a mill drill tool according to the present invention.
Figure 4B:
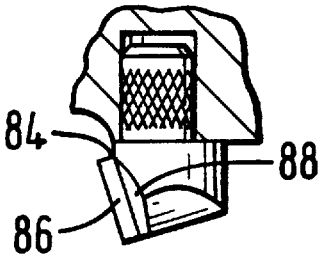
FIG. 4B is a side view of a mill drill element according to the present invention.

The mill drill tool 70 has a body 72 connected to a typical drill collar 74 which is part of a tubular string (not shown). Milling blades 76 project from the body 72 and are covered with milling material 78 for milling an opening through a wellbore tubular. A plurality of cutters 80 are disposed in sockets 82 in a lower end of the body 72. The cutters 80 may be typical drilling cutters or they may be as shown in FIG. 4B with a body 84 with a milling material portion 86 and a drilling material portion 88. Additional cutters 80 may be added to the lower end of the body 72 to enhance milling of a tubular. In one aspect the lower end is substantially covered with cutters. FIG. 4D is a cross-section view of the cutter of FIG. 4B.

Figure 4C:
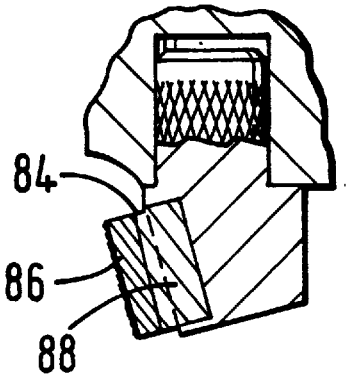
FIG. 4C is a cross-section view of the element of FIG. 4B.
Figure 4D:
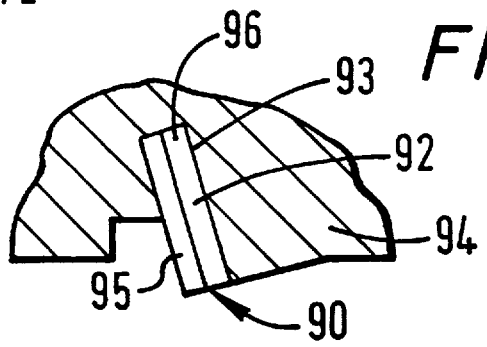
FIG. 4D is a cross-section view of the element of FIG. 4B.

FIG. 4C shows an alternative mill drill insert 90 with a body 92 mounted in a socket 93 in an end of a mill drill tool 94. The insert 90 has a milling portion 95 made of milling material for milling a wellbore tubular and a drilling portion 96 made of drilling material for drilling a formation. The milling portion 95 is sized so that it does not wear away until a tubular is milled through. Alternatively a milling insert or element may be emplaced on a mill drill tool and/or in a socket thereof on top of (in front of) a drilling insert or element. It is within the scope of this invention to emplace and secure in the sockets 93 one or more drilling elements behind one or more milling inserts or elements and/or to use PCBN elements.

Figure 5A:
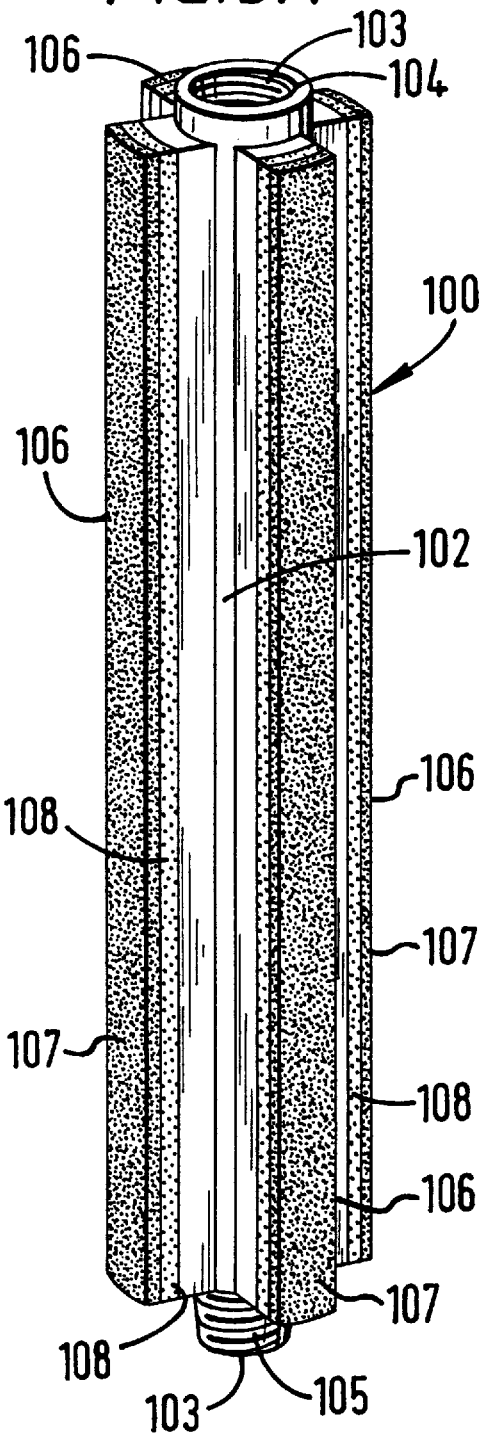
FIG. 5A is a perspective view of a drill collar according to the present invention.

Drill collars with a cutting surface are known in the prior art; see, e.g. U.S. Pat. No. 3,343,615 incorporated fully herein for all purposes. FIG. 5A shows a drill collar 100 with a body 102 having a flow bore 103 extending therethrough from top to bottom. Threaded ends 104, 105 make it possible to connect the drill collar 100 to other tools, tubulars, and devices. In one aspect two, three, or more such collars are connected together. The collar(s) may be used as a mill drill tool.

The drill collar 100 has projections 106 each with an outer layer of milling material 107 and an inner layer of drilling material 108. Although four projections 106 are shown, the drill collar 100 may have two, three, five, six or more such projections.

Figure 5B:
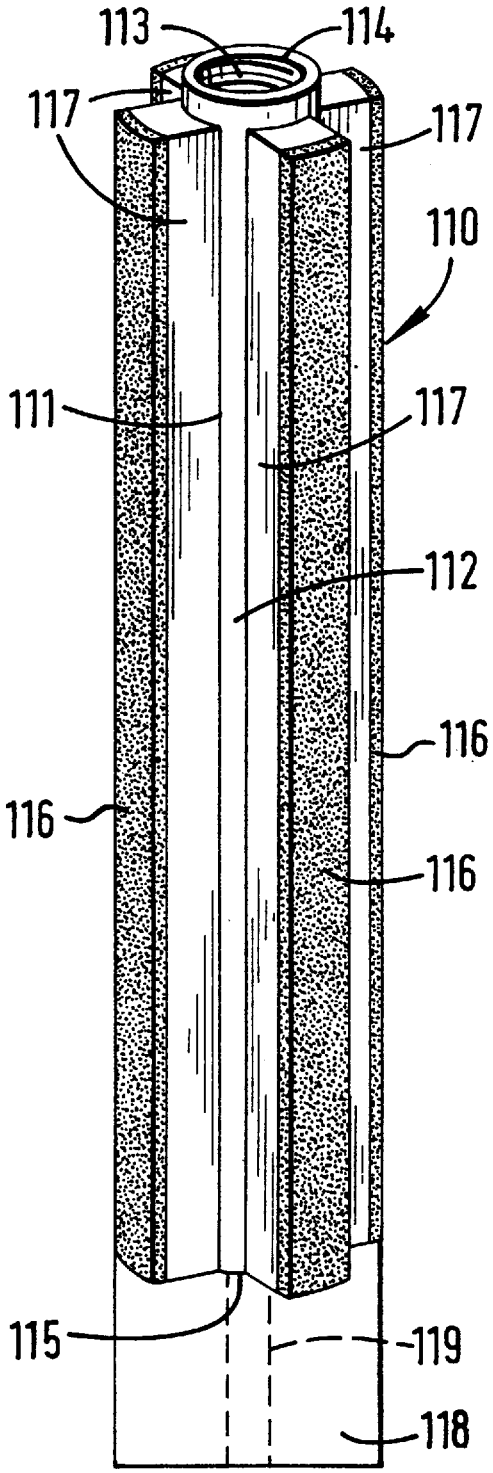
FIG. 5B is a perspective view of a mill drill tool according to the present invention.

FIG. 5B shows a mill drill tool 110 including a drill collar 111 (like that of U.S. Pat. No. 3,343,615) with a body 112 having a fluid flow bore 113 therethrough from a top end 114 to a bottom end 115. Drilling material 116 is on an exterior of each projection 117. Shown schematically is a mill 118 connected to the bottom of the drill collar 111. Two, three or more drill collars 111 may be connected end-to-end above the mill 118. The mill 118 may be releasably connected to the drill collar 111 and a spacer member (not shown) may be used between the mill 118 and the drill collar 111. The drill collar 111 may also have an outer layer of milling material on each of its projections (like the drill collar 100, FIG. 5A). A flow bore 119 communicates with the bore 113.

Figure 6A:
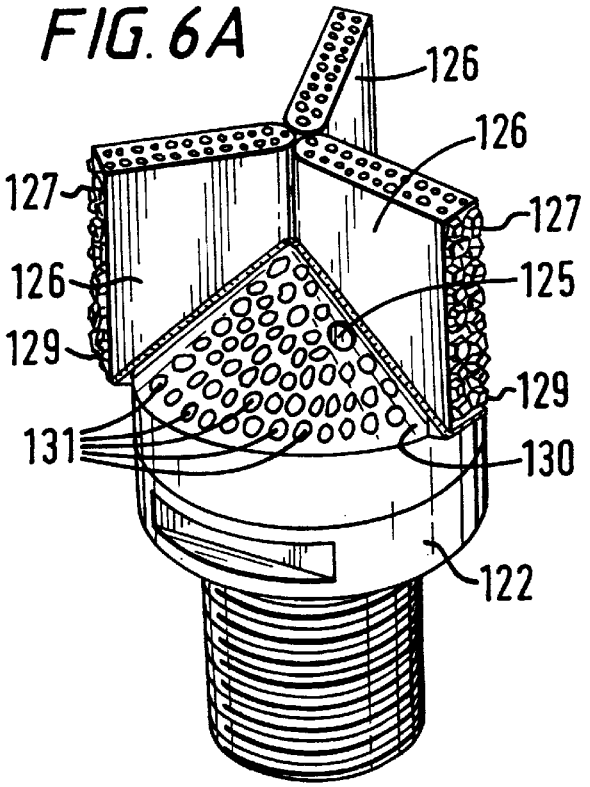
FIG. 6A is a perspective view of a mill drill tool according to the present invention.
Figure 6B:
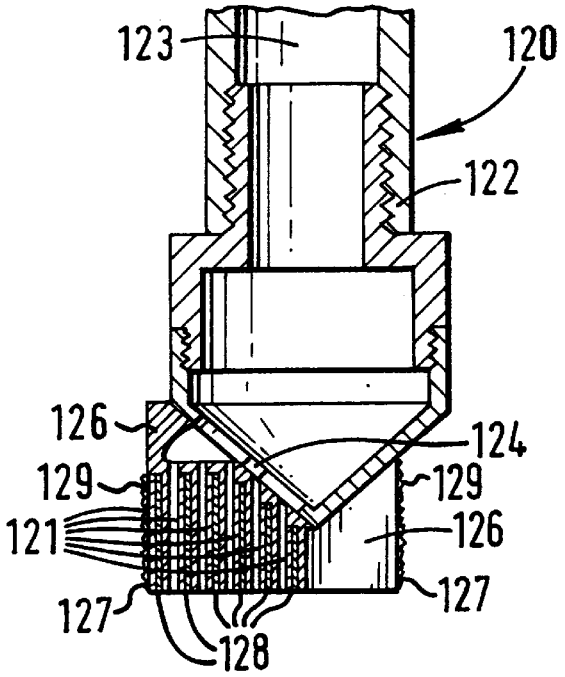
FIG. 6B is a cross-section view of the tool of FIG. 6A.
Figure 6C:
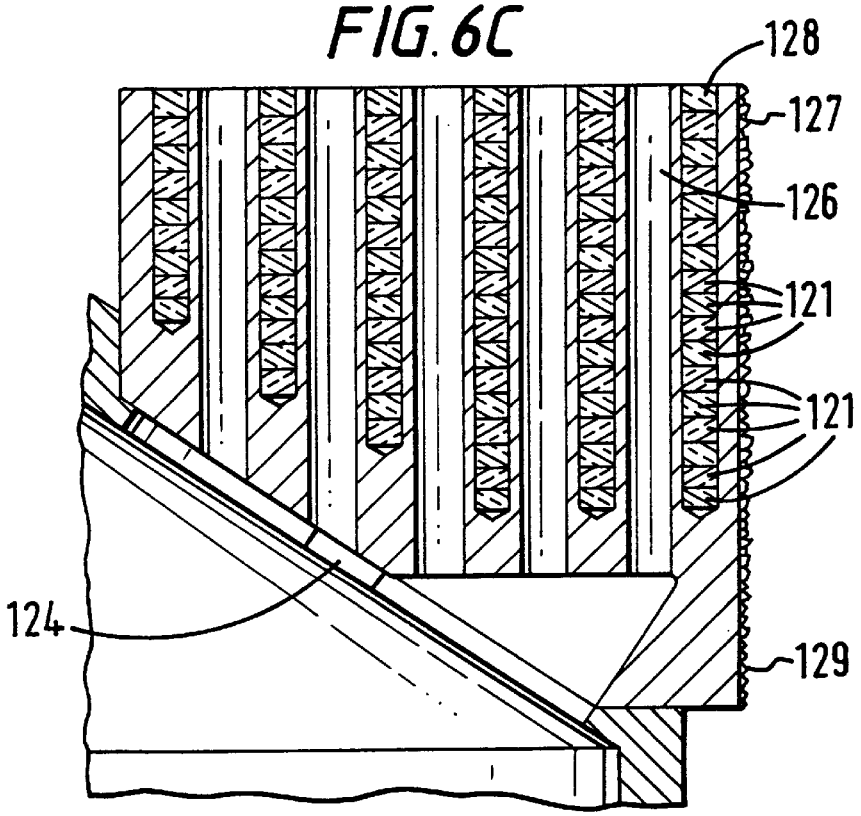
FIG. 6C is an enlarged view of a blade of the tool of FIG. 6A.

FIGS. 6A–6B show a mill drill tool 120 which, in some aspects, is like the bit of U.S. Pat. No. 4,719,979 (incorporated fully herein for all purposes) but which can also mill through a wellbore tubular prior to drilling a borehole.

The mill drill tool 120 has a body 122 with a flow bore 123 therethrough from top to bottom in communication with one or more jets 124 which have exit ports 125 adjacent each of a plurality of blades 126. Each blade 126 is dressed with milling material 127 and has mounted therein a plurality of milling inserts 128. Each blade also has drilling material 129 thereon and a plurality of drilling elements 121 therein. It is within the scope of this invention to substitute milling inserts 128 for some or all of the drilling elements 121, and vice versa. Mill drill inserts or drilling elements or inserts 131 (shown schematically in FIG. 6A) may also be disposed on conical surface 130 covering part or all of it.

Figure 7A:
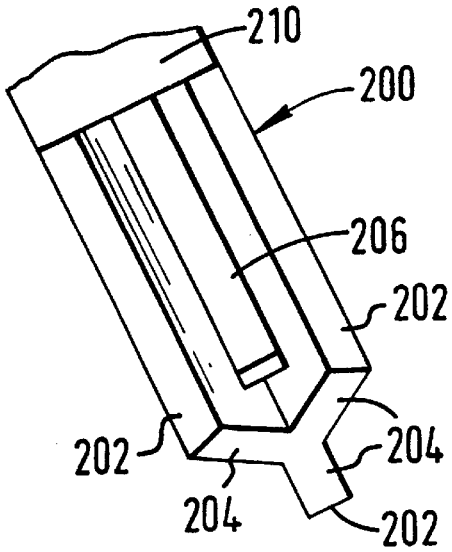
FIG. 7A is a schematic perspective view of a mill-drill tool according to the present invention.
Figure 7B:
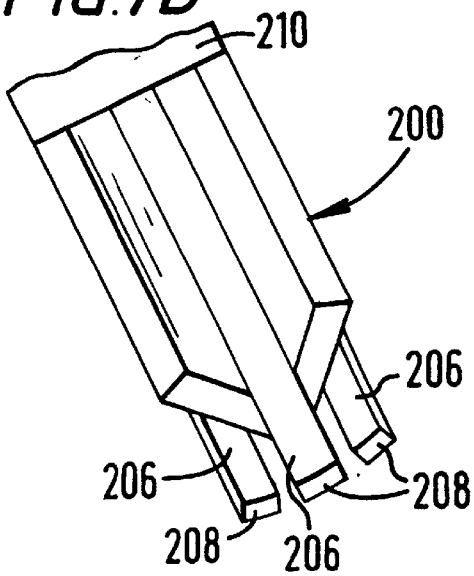
FIG. 7B is another view of the tool of FIG. 7B.

FIGS. 7A and 7B show a mill-drill tool 200 schematically with a plurality of milling members 202 each having an end or face milling surface 204 and a plurality of drilling members 206 each with an end or face drilling surface 208. A mechanism 210 interconnected with the drilling members 206 selectively moves the drilling members 206 from a first non-drilling position (FIG. 7A) to a second drilling position (FIG. 7B). Any known mechanism or device used for selectively advancing a member or selectively lowering and securing a part of a wellbore tool, device or apparatus may be used as the mechanism 210. The milling and drilling members may be enclosed in any suitable housing, sleeve, or tubular member and any known fluid flow system or structure may be used to provide fluid flow to the milling and drilling surfaces. The entire length of the milling members 202 may be made of milling material and the entire length of the drilling members 206 may be made of drilling material. Alternatively, an upper portion of the milling members may be made of drilling material to coincide with and be disposed adjacent the drilling members to facilitate drilling.

Figure 8:
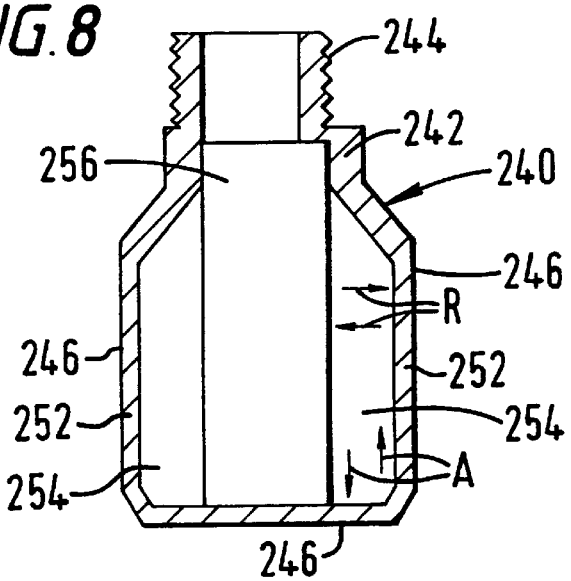
FIG. 8 is a side schematic view of a mill-drill tool according to the present invention.

FIG. 8 shows schematically a side cross-section view of a mill-drill tool 240 with a body 242 having an upper threaded end 244. Milling-drilling material 246, e.g. polycrystalline cubic boron nitride, in a matrix and/or with cutting elements made therefrom covers a plurality of cutting blades 252 (two shown; three, four, five, six, seven, eight, nine or more within the scope of this invention) disposed on and around the body 242. For each blade 252 there is a corresponding buffer member 254 adjacent thereto and, in one aspect, in contact therewith, each buffer member interconnected with a movement mechanism 256 (shown schematically). The buffer members 254 are selectively movable both radially (arrows R) and axially (arrows A) so that a selected amount of the milling-drilling material is provided so that the cutting depth of the mill-drill tool is controlled. For the continuous milling of a metal tubular a certain amount of the milling-drilling material is "freed," i.e., with no buffer member portion adjacent thereto. For drilling, the buffer members are retracted axially and radially to "free" more of the milling-drilling material so that a bigger "bite" can be taken into a formation.

Figure 9A:
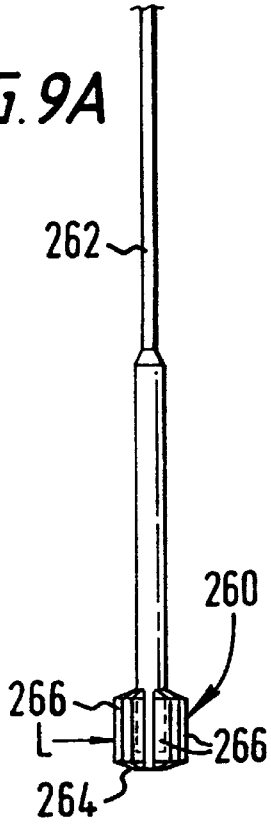
FIG. 9A is a side view of a mill-drill tool according to the present invention.
Figure 9B:
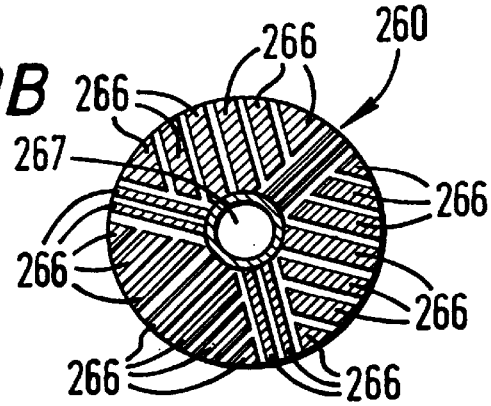
FIG. 9B is a bottom view of the tool of FIG. 9A.

FIG. 9A shows a mill-drill tool 260 according to the present invention connected to the lower end of a string 262. The tool 260 has a body 264 with a plurality of mill-drill members 266 that extend within the body 264 from top to bottom and which, at the lower end, extend across part of the end face of the body 262. Up to a certain level L, each mill-drill member 266 is made of milling material. Above the level L, each mill-drill member 266 is made of drilling material. The level L is chosen, in one aspect, so that there is sufficient milling material to mill through a tubular. Interspersed between the mill-drill members 266 may be milling matrix material up to the level L and drilling matrix material above the level L. Alternatively, the space between these members may be void and empty, or filled with any suitable metal or other filler. A central flow bore 267 provides fluid to the end of the tool from the surface pumped through the string 262. As desired sub-channels may be provided to effect jetting fluid action at the end of and/or on the sides of the tool.

Figure 10A:
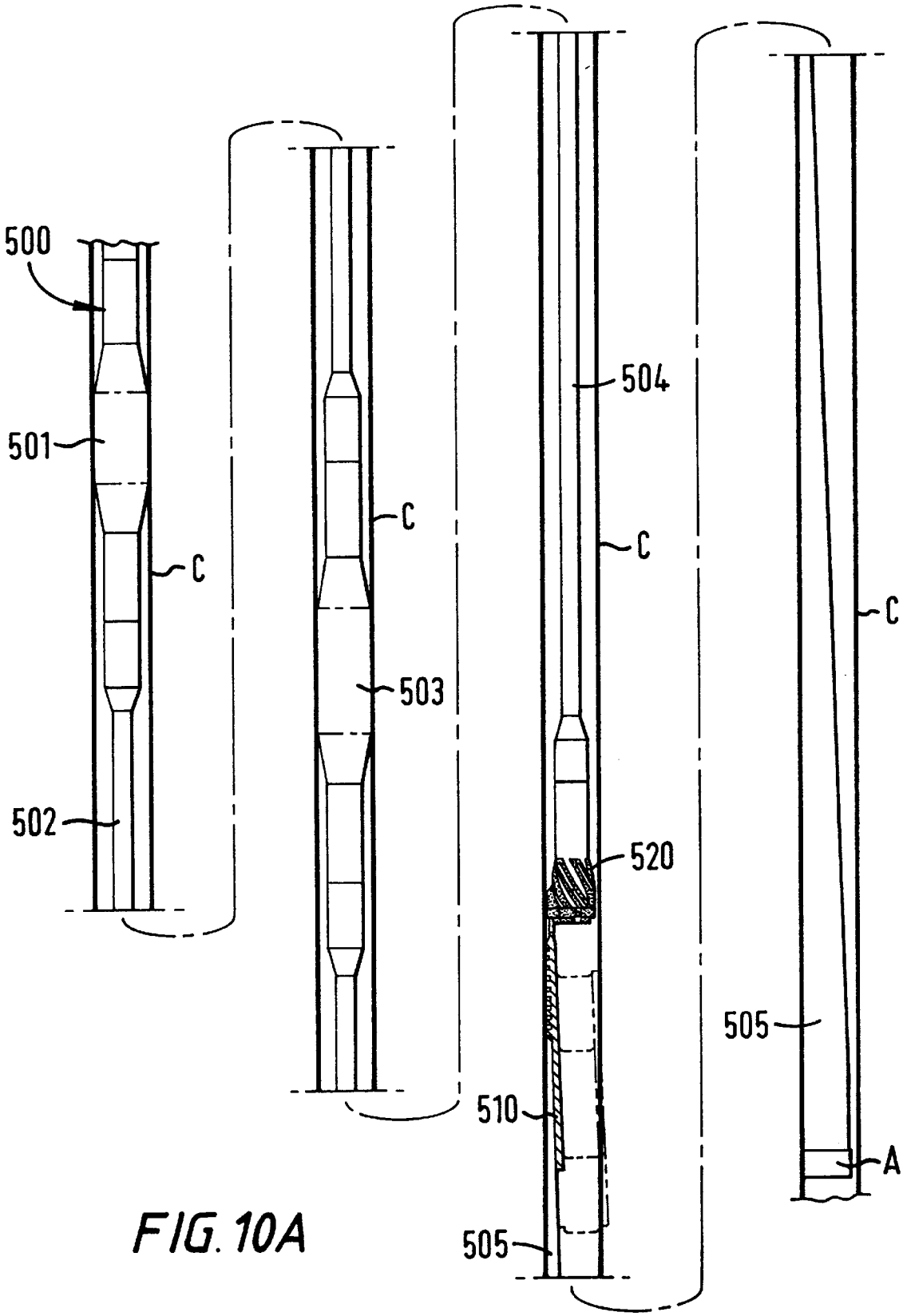
FIG. 10A is a side view in cross-section of a wellbore tool system according to the present invention.

As shown in FIG. 10A a system 500 has a top watermelon mill 501 (shown schematically in FIG. 10A) which is connected to a flexible member, flexible pipe, or flex sub 502. The flex sub 502 is connected to a second watermelon mill 503 which is connected to a second flex sub 504. The flex sub 504 is connected to a cutting tool, in one aspect a mill-drill tool 520. The mill-drill tool 520 is releasably connected to a sacrificial face element 510. The sacrificial face element is connected to a whipstock 505. The whipstock 505 is anchored in a tubular, e.g. casing C of a casing string in a wellbore, by an anchor A which is any known anchor, anchor-packer, packer, or setting apparatus.

It is within the scope of this invention to use any additional mill or combination of mills with the mill-drill tool 520 other than or in addition to the watermelon mills (or either of them) shown in FIG. 10A. It is within the scope of this invention to divert the mill-drill tool 520 with any known diverter or whipstock or with any known movable joint(s), knuckle joint(s), or selectively actuable device for moving the mill-drill tool [(or mills)] laterally.

Figure 10B:
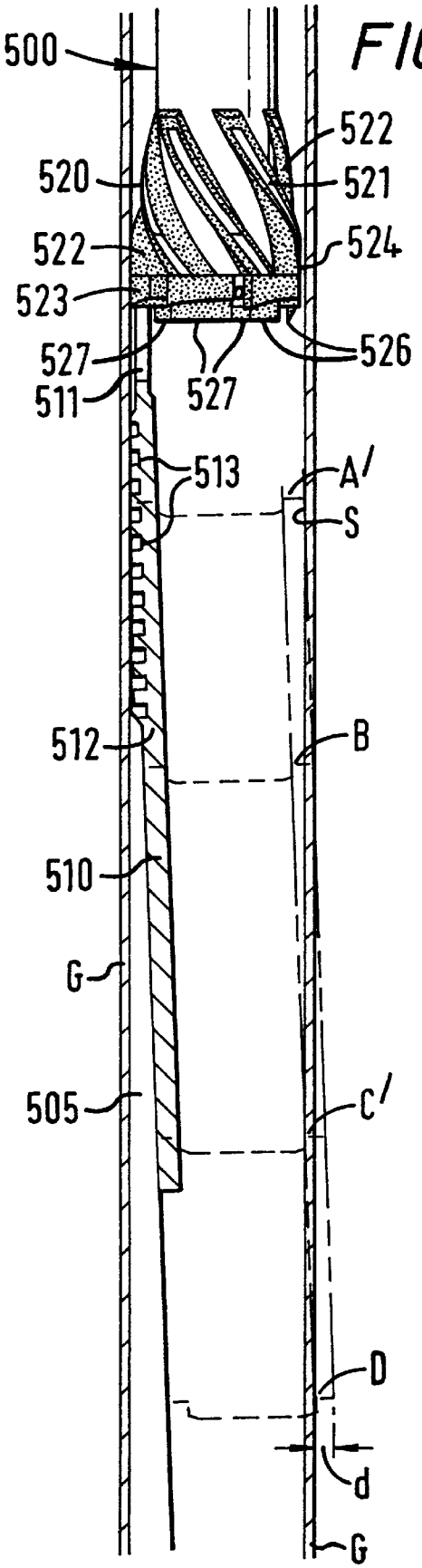
FIG. 10B is an enlarged view of part of the system of FIG. 10A.
Figure 11A:
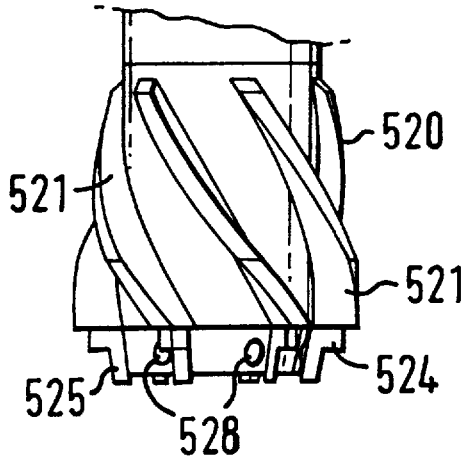
FIG. 11A is a side view of a mill of the system of FIG. 10A.

As shown in FIG. 11A, the mill-drill tool 520 (shown without the material 527) has side blades 521 dressed with matrix milling material 522 (see FIG. 10B). In one aspect the exterior blade surfaces of the side blades 521 are smooth (e.g. ground smooth with a grinder). The matrix milling material may be any known mill dressing material applied in any known manner.

Matrix milling material 523 covers lower ends 524 of the side blades 521 (see, e.g. FIG. 11A and FIGS. 12A–12C). Blades 525 (see FIG. 11A) on a nose 526 of the mill-drill tool 520 are initially laterally protected with a material 527 (e.g. but not limited to bearing material such as brass) and, optionally partially or wholly covered with wear away material or with matrix milling material 523 (see FIG. 12C). Fluid under pressure, pumped from the surface, exits through ports 528 at the lower ends 524 of the side blades 521. Blades 525 may be milling blades or drilling blades or a combination thereof. Alternatively a drill bit or drilling part of a drill bit may be used instead of the blades 525. To initially isolate, cover, and/or protect the blades 525 or apparatus 555 (FIG. 14A), instead of separate and distinct members or bodies 527, a cylindrical member (closed off or open at the bottom, a ring, or a hollow cap may be used, either secured immovably to the body, blades, or apparatus or rotatably secured thereto. The material 523 may act like a bearing or bearing material may be used in its place so that the side portion of tool acts as a bearing.

Two fingers 511 extend upwardly from a body 512 of the sacrificial face element 510. The fingers 511 are releasably connected to the mill-drill tool 520 (e.g. by shear bolts). Knobs 513 project from the body 512 (see FIGS. 13A–13D). From top to bottom the knobs project increasingly from the body 512 to correspond to a taper of the whipstock 505. Alternatively a series of grooves (up-and-down or side-to-side) may be used instead of the knobs 513. It is within the scope of this invention to employ at least one recess, a series of recesses, or a series of recesses at angles to each other to reduce the amount of material of the element 510. The sacrificial face element 510 may be welded or bolted to the whipstock or made integrally thereof. In one aspect the sacrificial face element 510 is made of millable material or bearing material (e.g. bearing bronze). In one aspect the element 510 is made of bronze. In milling down the body 512 of the element 510, the mill-drill tool 520 mills the body 512 more easily than if material were present between the knobs 513. Instead of an integral solid remainder of the body 512 left after the mill-drill tool 520 has passed, small pieces of the body 512 (knobs or knobs with portions of the body 512) are left rather than a floppy piece which impedes operations or large pieces which may be difficult to mill or to circulate. Small pieces or chunks may fall down and/or fall away following milling and are more easily circulated away from the milling location and/or out of the hole.

Figure 13A:
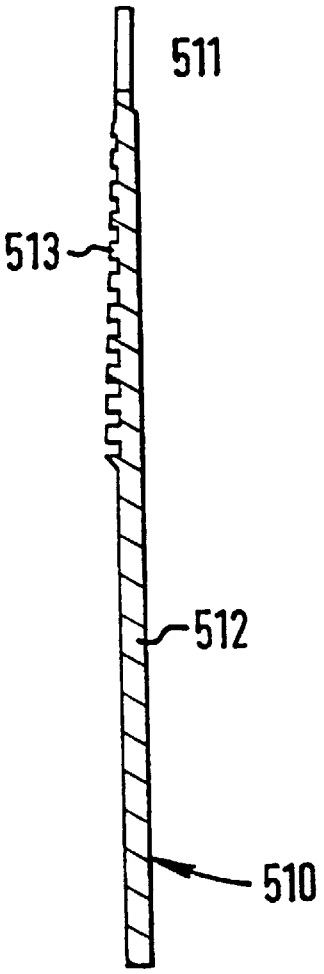
FIG. 13A is a side view of a sacrificial face element of the system of FIG. 10A.
Figure 13B:
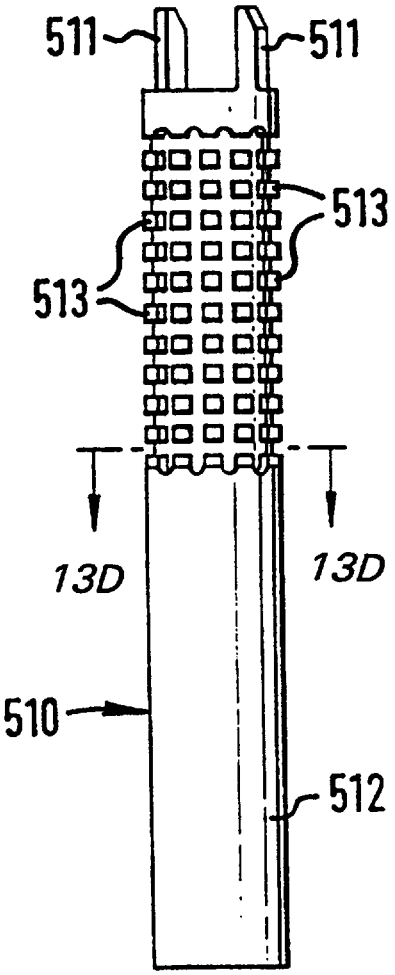
FIG. 13B is a front view of the element of FIG. 13A.
Figure 13C:
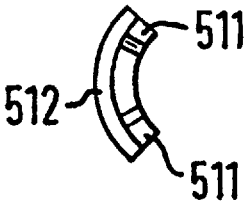
FIG. 13C is a top view of the element of FIG. 13A.
Figure 13D:
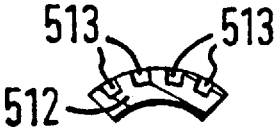
FIG. 13D is a cross-section view along line 13D—13D of FIG. 13B.
Figure 13E:
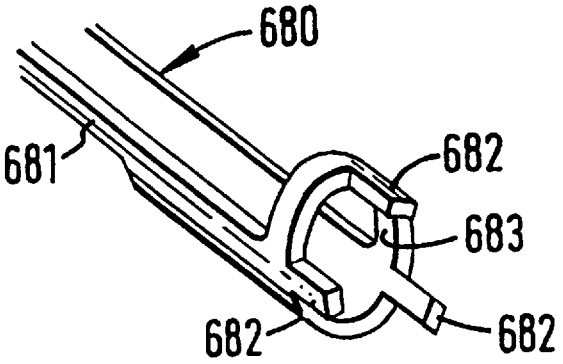
FIG. 13E is a perspective view of an element according to the present invention.

FIG. 13E shows an alternative sacrificial face element 680 with a body 681 and fingers 682 projecting from a ring 683. One or more of the fingers 682 are releasably connectible to a mill, mill system, or mill-drill tool (e.g. in a manner similar to that as described for the element 510). The element 680 is made of steel, plastic, metal millable or drillable material, or bearing material in certain embodiments, or any of the materials out of which the element 510 is made. A knob structure (see knobs 513 of the element 510) may be provided for the element 680. As is the element 510, the element 680 is securable to a whipstock and the body 681 (shown partially) may extend for any desired and suitable length along a whipstock and the body may have any desired taper to correspond to a whipstock on one side and to direct cutting apparatus on the other side. The ring 683 is sized, in one aspect, so a nose or projecting lower end of a mill or mill-drill tool may extend into the ring and, in one aspect, contact the ring for stability. The ring also strengthens the element.

Figure 14B:
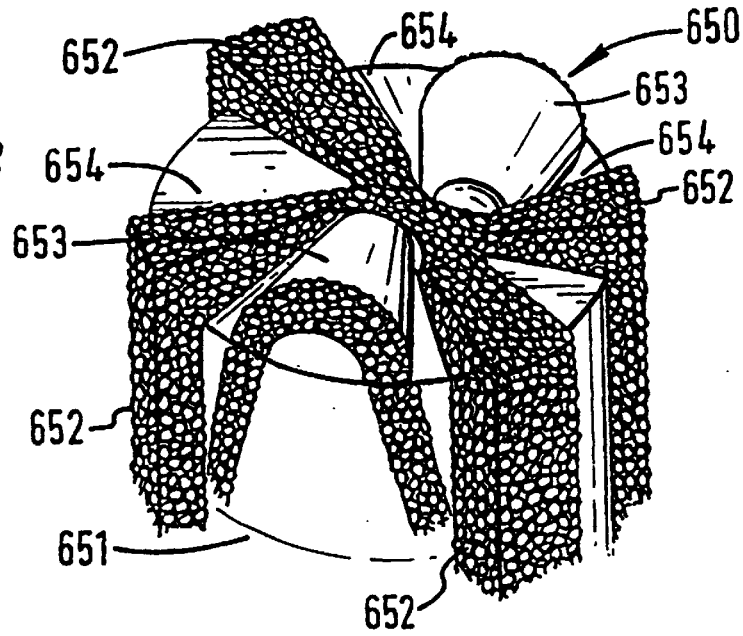
FIG. 14B is a perspective view of a mill-drill tool according to the present invention.
Figure 14A:
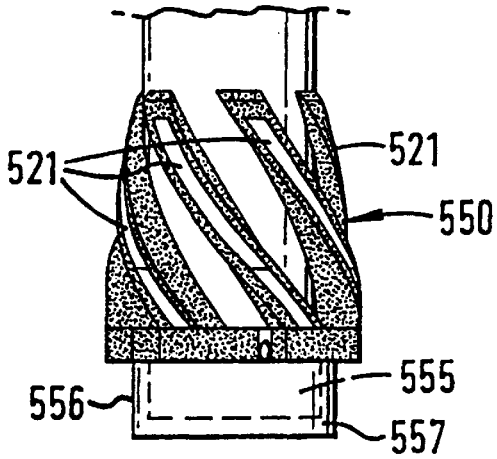
FIG. 14A is a side view of a milling-drilling tool according to the present invention.

FIG. 14A shows a mill-drill tool 550 (similar to the mill-drill tool 520 with like parts bearing the same indicating numerals). Drilling apparatus 555, shown schematically by a dotted line, is initially covered by a material 557 which may be worn away by contact with a tubular and/or formation. In one aspect, as with the system 500, the material is not worn away until milling blades have milled the tubular allowing the material 557 to contact the tubular. A nose 556 including the material 557 and drilling apparatus 555 is sized, configured, and located on the mill-drill tool 550 so that the material 557 is not worn away or worn away only minimally until the nose 556 contacts the tubular. By using bearing material as the material 557 movement of the nose down and against the sacrificial element (e.g. element 510) is facilitated. The drilling apparatus 555 may be any suitable known drilling apparatus which can cut the tubular and the formation in which it extends. In another aspect drill apparatus is positioned under or within, or interspersed with milling apparatus. In another aspect the material 557 is known matrix milling material used, optionally, with known milling inserts or cutting elements, with or without chipbreakers, in any known pattern or array.

FIG. 14B shows a mill-drill tool 650 with a cylindrical body 651 (shown partially), a plurality of milling blades 652 dressed with matrix milling material, and two rotatable drill bit roller cones 653. (One, three, four, or more such cones may be used.) As viewed in FIG. 14B, the drill bit roller cones 653 may be disposed to project beyond (upwardly in FIG. 14B) a top surface 654 of the milling blades 652. Alternatively, the cones may be at a similar level as or below the top surfaces 654.

Figure 14D:
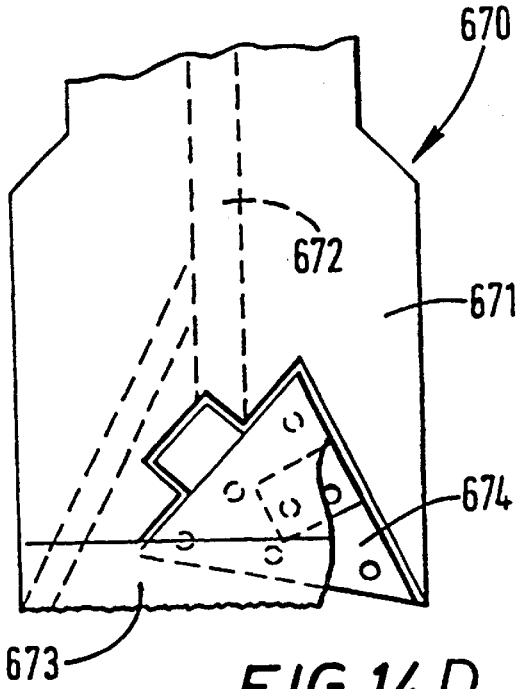
FIG. 14D is a schematic side view partially in cross-section of a mill-drill tool according to the present invention.
Figure 14C:
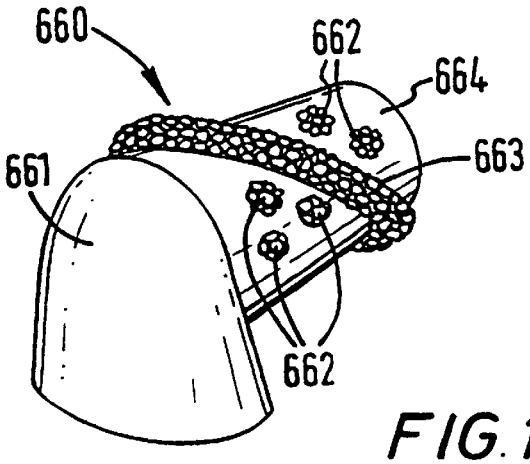
FIG. 14C is a perspective view of a mill-drill rotary roller bit cone according to the present invention.

FIG. 14C shows a drill bit roller cone 660 with a rotatable cone 664 on a body 661 (which is mountable or formable in known manner as part of a drill bit or mill-drill tool), the cone having thereon stubs of drilling material 662 and a projecting body 663 of milling material, e.g. welded to the body 661. Such a cone may replace the one or more of the cones of the mill-drill tool 650. Alternatively a blade body may be formed on the body 661 which is then dressed with matrix milling material.

FIG. 14D shows schematically a mill drill tool 670 with a cylindrical body 671 having a fluid flow bore 672 therethrough, a milling surface 673 and a rotatable drill bit roller cone 674 rotatably mounted to the body. Optionally lateral milling blades may be provided on the vertical sides of the body 671.

Figure 10C:
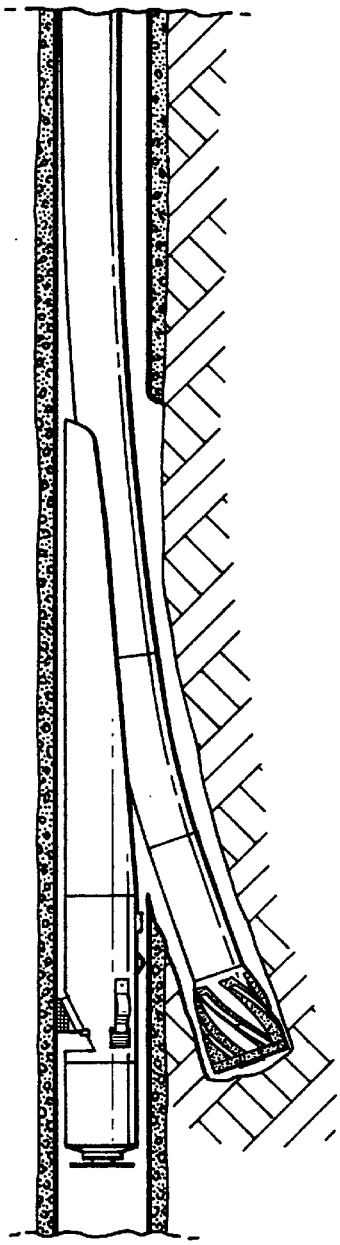
FIG. 10C shows a window milled in a tubular and a lateral wellbore extending from a main wellbore formed with the system of FIG. 10A.

FIG. 10B shows the system 500 in a cased wellbore with various positions of the mill-drill tool 520 shown in dotted lines. Initially (as shown) the mill-drill tool 520 has not been released from the fingers 511. Following release from the fingers 511 and downward movement, the lower ends 524 of the blades 521 have milled away a portion of the sacrificial element 510 including the fingers 511 and the outer blade surfaces have moved to contact at point A an inner surface S of a casing C in a wellbore. A distance d is, preferably, of sufficient extent that the lower blade surface along the distance d is wider than the casing thickness t. The blades mill down the sacrificial element 510, leaving "chunks" thereof behind as the mill-drill tool 520 moves onto the whipstock 505 and blades reach the outer surface of the casing at point B. The outer blade surfaces which contact the whipstock are, preferably, smooth to facilitate movement of the mill-drill tool 520 down the whipstock 505 and to minimize milling of the whipstock 505 itself. The mill-drill tool 520 continues downwardly (e.g. rotated all the while by a surface rotary or by a downhole motor in the string at some point above the mill-drill tool), milling away the sacrificial element 510, moving down the whipstock 505, milling through the casing C, to a point C at which outer surface of the material 527 of the nose 526 contacts the inner surface of the casing C. At this point the material 527 begins to be worn away, exposing the drilling apparatus, milling apparatus, or milling-drilling apparatus underneath the material 527. The mill-drill tool 520 continues to mill down the casing to a point D at which the nose 526 begins to exit the casing C and the mill-drill tool 520 begins to cut the formation outside the casing C. The mill-drill tool moves down the whipstock 505 forming the beginning of a lateral wellbore. A lateral wellbore L thus formed is shown in FIG. 10C. Such a wellbore may be any desired length including, but not limited to: about one foot long; two feet long or less; five feet long or less; between five feet and fifty feet long; one hundred feet long or less; between about one hundred and about two hundred feet long; two hundred feet long; five hundred feet long; a thousand feet long; or several thousand feet long.

When a full gauge body is used for the mill-drill tool 520, the resulting window and lateral wellbore are full gauge, i.e. a desired diameter and no further milling is required—as opposed to certain prior art systems using a tool which is less than full gauge, e.g. an under gauge lead mill, producing a "rathole" of a smaller diameter than the diameter of the bore above the rathole which must be milled further to enlarge it to the desired diameter—often requiring one or more additional trips into the wellbore or requiring the drilling of an excessively long rathole.

By using a system as described herein, a completed lateral wellbore of a desired diameter can be achieved which extends any desired length into the formation or only a relatively short distance from the casing; i.e., the extent to which the lateral wellbore's initial opening extends into the formation can be relatively small which facilitates the production of a lateral wellbore at a desired angle to the primary wellbore. With certain prior art systems which do not use a full gauge tool body and which do employ narrower mills, e.g. under gauge lead mills, when the desired window is completed the lateral wellbore (including the portion of the formation of narrow diameter into which the starting mill has moved) may be ten, fifteen, twenty or more feet long. It is relatively difficult to produce a lateral wellbore turned at a desired angle from such a relatively long initial lateral wellbore. With systems according to the present invention a uniform diameter relatively short full gauge initial lateral wellbore may be produced in the formation in a single trip. In one aspect such an initial lateral wellbore is five feet long or less, three feet long or less, two feet long or less, or about one and a half feet long. It is also within the scope of this invention to use an additional mill or mills and/or multiple blade sets, i.e. one or more additional sets of blades above the mill-drill tool 520.

Filed on Jul. 30, 1996 and co-owned with this application is the U.S. application Ser. No. 08/688,301 entitled "Wellbore Window Formation" incorporated fully herein for all purposes. Incorporated fully herein for all purposes is pending U.S. application Ser. No. 97/642,118 filed on May 2, 1996 entitled "Wellbore Milling System." All applications and patents referred to herein are incorporated fully herein for all purposes.

Figure 15:
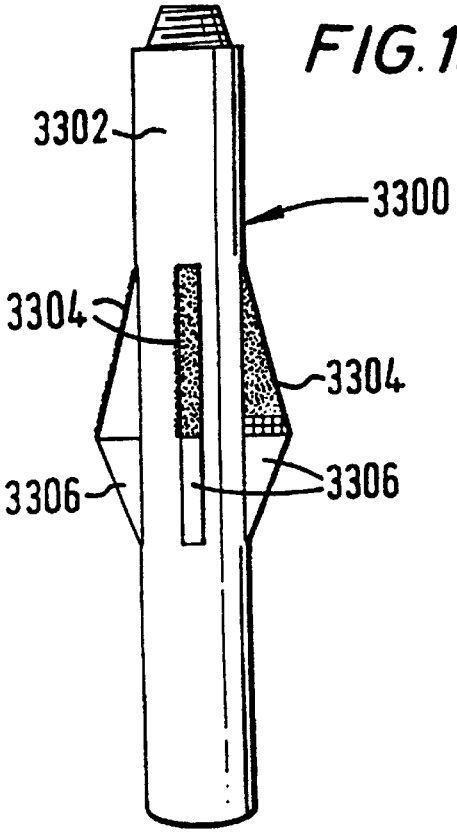
FIG. 15 is a side view of a mill according to the present invention.

FIG. 15 shows a mill 3300 according to the present invention with a body 3302 and a plurality of blades 3304. Associated with each blade 3304 is a taper member 3306 which is secured to the body 3302, or to the blade 3304, or to both, either with an adhesive such as epoxy, with connectors such as screws, bolts, or Velcro™ straps or pieces, or by a mating fit of parts such as tongue-and-groove. The taper members may be made of any suitable wood, plastic, composite, foam, metal, ceramic or cermet. In certain embodiments the taper members are affixed to the mill so that upon contact of the lower point of the mill blades with the casing to be milled, the taper members break away so that milling is not impeded.

Figure 16:
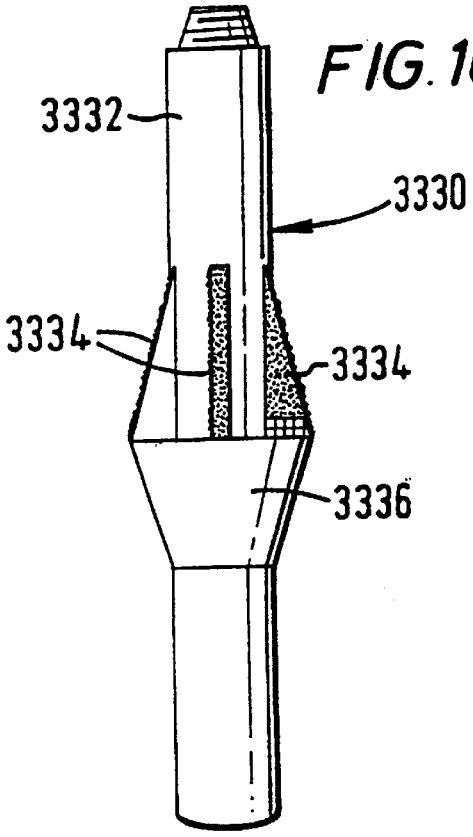
FIG. 16 is a side view of a mill according to the present invention.

FIG. 16 shows a mill 3330 according to the present invention with a body 3332 and a plurality of blades 3334. A taper device 3336 is secured around the mill 3330 or formed integrally thereon. The taper device 3336 extends around the entire circumference of the mill 3330 beneath the blades 3334 and facilitates movement of the mill 3330 through tubulars. The taper device 3336 may be a two-piece snap-on or bolt-on device and may be made of the same material as the taper member 3306.

Figure 17:
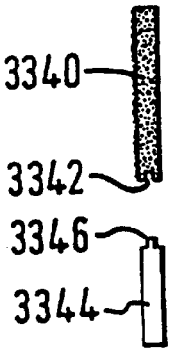
FIG. 17 is a side view of a blade with a taper member according to the present invention.

FIG. 17 shows a blade-taper member combination with a blade 3340 having a groove 3342 and a taper member 3344 with a tongue 3346. The tongue 3346 is received in the groove 3342 to facilitate securement of the taper member 3344 to the blade 3340. Optionally, an epoxy or other adhesive may be used to glue the taper member to the blade, to a mill body, or to both. The tongue and groove may be dovetail shaped.

Figure 18:
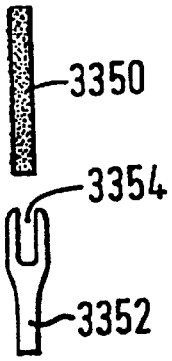
FIG. 18 is a side view of a blade with a taper member according to the present invention.

FIG. 18 shows a blade-taper member combination with a blade 3350 and a taper member 3352 with a recess 3354. The blade 3350 is received in and held in the recess 3354. Optionally an adhesive may be used to enhance securement of the taper member 3352 to the blade, to the mill, or to both.

Figure 11B:
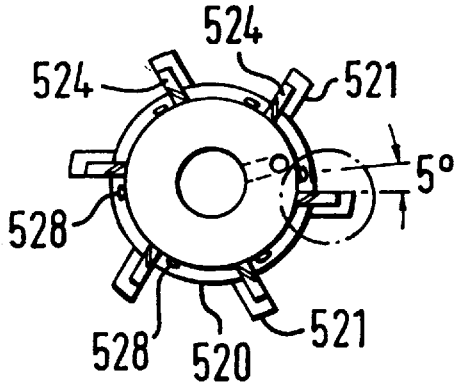
FIG. 11B is an end view of the mill of FIG. 11A.
Figure 11C:
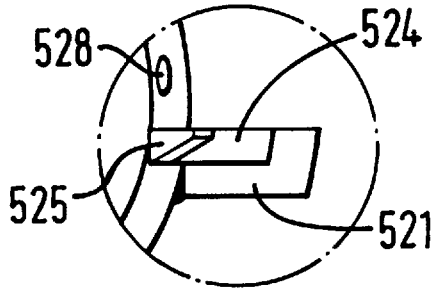
FIG. 11C is an enlargement of part of the mill as shown in FIG. 11B.
Figure 12A:
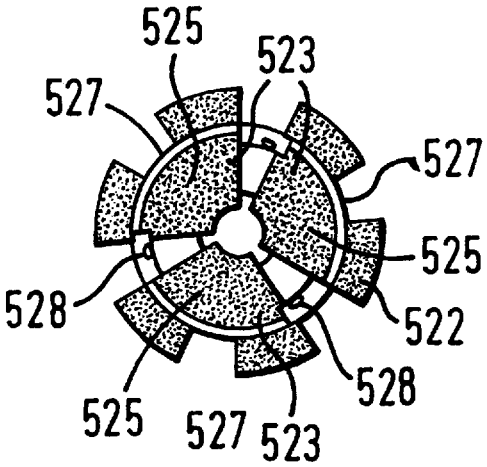
FIG. 12A is an end view of the mill of the system of FIG. 10A.
Figure 12B:
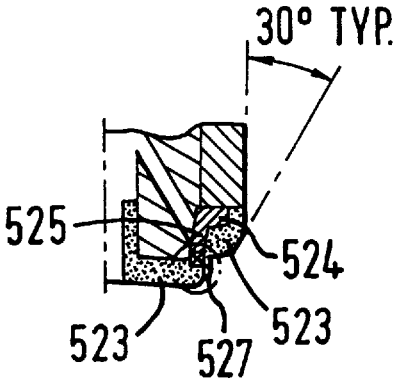
FIG. 12B is a side view in cross-section of part of the mill as shown in FIG. 12A.
Figure 12C:
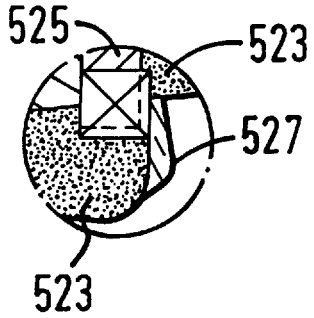
FIG. 12C is an enlargement of part of the mill as shown in FIG. 12B.
Figure 19:
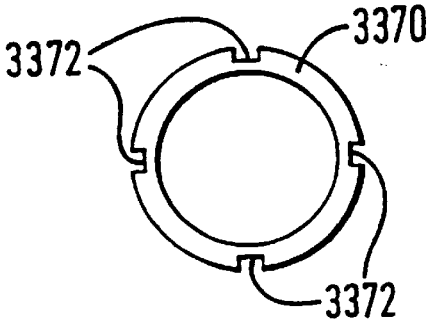
FIG. 19 is a bottom view of a mill body according to the present invention.

FIG. 19 shows a mill body 3370 (like the bodies of the mills shown in FIGS. 5A, 10, and 11 of pending U.S. application Ser. No. 08/642,118 filed May 2, 1996), with a series of grooves 3372 therein which extend longitudinally on the mill body and are sized, configured, and disposed to receive and hold a taper member as shown in FIG. 15, FIG. 17, or FIG. 18. Such a mill body may be used instead of or in combination with any previously-described taper securement means.

Figure 20:
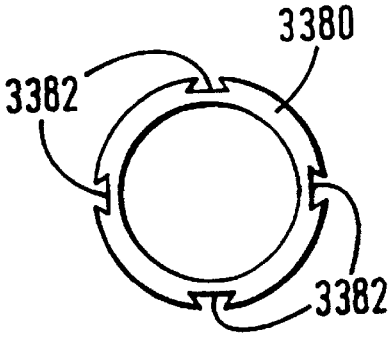
FIG. 20 is a bottom view of a mill body according to the present invention.

FIG. 20 shows a mill body 3380 (like the bodies of the mills mentioned in the previous paragraph), with a series of dovetail grooves 3382 therein which extend longitudinally on the mill body and are sized, configured, and disposed to receive and hold a taper member as shown in FIG. 15, FIG. 17, or FIG. 18. Such a mill body may be used instead of or in combination with any previously-described taper securement means.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A tool for wellbore sidetracking operations, the tool comprising a body, a milling section on the body for milling an opening in a tubular in a first wellbore in a formation, the milling section having a body with milling material thereon, a drilling section on the body for drilling a second wellbore beyond the window into the formation, and a release member interconnected between the drilling section and the milling section for selectively releasing the milling section from the drilling section thereby freeing the drilling section for drilling.

2. The tool of claim 1 wherein the milling section is a full gauge milling apparatus so that the second wellbore is of a substantially uniform diameter along its entire length.

3. The tool of claim 1 wherein the milling section includes a plurality of milling blades extending from the body.

4. The tool of claim 1 wherein the milling section comprises a window mill.

5. The tool of claim 1 wherein the milling section comprises a plurality of blades with a plurality of cutting elements therein.

6. The tool of claim 5 wherein the plurality of cutting elements comprises a plurality of milling elements and a plurality of drilling elements.

7. The tool of claim 1 further comprising a plurality of mill drill elements on the body.

8. The tool of claim 1 wherein the drilling section is a drill collar having a body with projections extending laterally therefrom and drilling material on an exterior surface of each projection.

9. The tool of claim 1 further comprising a wear-away covering on the drilling section.

10. A tool for wellbore sidetracking operations, the tool comprising a body, a milling section on the body for milling an opening in a tubular in a first wellbore in a formation, the milling section having a body with milling material thereon, a drilling section on the body for drilling a second wellbore beyond the window into the formation, and wherein the drilling section includes a plurality of bit roller cones rotatably secured to the body.

11. The tool of claim 10 wherein each bit roller cone is secured to an arm secured to the body.

12. The tool of claim 11 wherein an exterior surface of each arm has milling material thereon.

13. The tool of claim 10 wherein each bit roller cone has a plurality of mill drill elements thereon.

* * * * *

UNITED STATES PATENT AND TRADEMARK OFFICE

CERTIFICATE OF CORRECTION

PATENT NO. : 5,887,668
DATED : Haugen, et al.
INVENTOR(S) : March 30, 1999

It is certified that error appears in the above-identified patent and that said Letters Patent is hereby corrected as shown below:

Drawing

Signed and Sealed this

Twenty-third Day of October, 2001

*Attest:*

Nicholas P. Godici

NICHOLAS P. GODICI

*Attesting Officer*

*Acting Director of the United States Patent and Trademark Office*